United States Patent [19]

Vannier

[11] Patent Number: 4,595,055

[45] Date of Patent: Jun. 17, 1986

[54] CENTERING APPARATUS

[75] Inventor: Daniel Vannier, St Cyr l'Ecole, France

[73] Assignee: Schlumberger Technology Corporation, Houston, Tex.

[21] Appl. No.: 608,057

[22] Filed: May 8, 1984

[30] Foreign Application Priority Data

May 10, 1983 [FR] France ..... 8307831

[51] Int. Cl.[4] ..... E21B 17/10

[52] U.S. Cl. ..... 166/241; 33/178 F

[58] Field of Search ..... 166/241, 166, 172; 33/178 F, 178 R; 175/325

[56] References Cited

U.S. PATENT DOCUMENTS

| | | | |
|---|---|---|---|
| 2,251,040 | 7/1941 | Dewees | 33/178 F X |
| 2,267,110 | 12/1941 | Kinley et al. | 33/178 F |
| 2,497,990 | 2/1950 | Hubber et al. | 33/178 F |
| 2,899,633 | 8/1959 | Smith et al. | 33/178 F |
| 2,971,582 | 2/1961 | Marsh | 166/241 |
| 3,092,182 | 6/1963 | Blagg | 166/241 |
| 3,097,433 | 7/1963 | Cubberly, Jr. | 33/178 F X |
| 3,555,689 | 1/1971 | Cubberly, Jr. | 166/241 X |
| 3,915,229 | 10/1975 | Nicolas | 166/241 |
| 4,243,099 | 1/1981 | Rodger, Jr. | 166/241 X |

*Primary Examiner*—Stephen J. Novosad
*Assistant Examiner*—Thuy M. Bui

[57] ABSTRACT

A device for centering a tool forming a part of a tool string, inside a cased well, comprises a central bar suitable for being integrated in a tool string for lowering the tool inside the tubing, two slides which are slidable over a limited range of said central bar, and a series of wheel-carrying structures of generally triangular geometry defined by arms which are hinged to said slides. The device further comprises a series of wheels with each wheel being mounted to rotate freely on a respective one of said wheel-carrying structures in a plane which is inclined relative to a radial plane through the wheel-carrying structure in such a manner that its periphery projects radially outwardly. When the wheel-carrying structures are fully retracted against the central bar, the wheels are received in recesses provided in the outer surface of the central bar. Resilient return means are provided to urge the wheels radially outwardly.

14 Claims, 11 Drawing Figures

CENTERING APPARATUS

BACKGROUND OF THE INVENTION

The present invention relates to devices for centering tools in a cased well, and in particular for centering tools in deviated cased wells.

The work performed inside a well often requires that a tool which passes through the well be properly centered therein. This is particularly true when measuring the transverse dimensions of a well as described for example in French patent application No. 81 24021 filed Dec. 22, 1981, corresponding to U.S. Application No. 450,595 filed Dec. 17, 1982.

There are technical difficulties in developing entirely satisfactory centering devices. Firstly, the casing of a well has localised variations in diameter both at joints and at the valves situated at the well head. The centering device must therefore be capable of adapting to such variations in diameter. In the industry, such an adaptive centering device is often called a "centralizer". Furthermore, the recent tendency, particularly for offshore drilling, is to drill deviated wells which depart substantially from the vertical on one or more occasions. As a result, the operation of the centering device is perturbed by the effect of gravity on the tools centered by the device which effect operates laterally on the centering device.

Finally, to obtain proper centering, the device will by necessity bear against the walls of the well. In many prior art devices, sliding means are used to bear against the wall of the casing. This is true, in particular, for the centralizers described in U.S. Pat. Nos. 3,097,433, 3,555,689, and 3,915,229. This type of bearing is no longer entirely satisfactory, in particular in deviated wells, since it tends to alter the state of the inside wall of the casing, and thereby accelerate corrosion; furthermore it tends to limit the critical deviation angle beyond which the tool will no longer advance under the effect of its own weight.

In order to remedy the above drawbacks, a centralizer has been proposed in the literature in which contact with the wall of the well casing is provided by wheels, e.g., "Improved Technique for Logging High-Angle Well" by M. W. Bratovich, W. T. Bell & K. D. Kaaz, published under the reference SPE 6818 by the American Institute of mining Metallurgical Petroleum Engineers, Inc. In FIG. 3B of that article a centering device is shown which comprises a central bar suitable for being attached to a tubing string for lowering a tool in a cased well, two moving slides capable of sliding to a limited extent over the central bar, a series of radial wheel-carrying structures of generally triangular geometry defined by arms articulated to the two slides, a series of wheels mounted free to rotate on each of the radial structures in such a manner that the periphery of each series of wheels projects radially outwardly, and resilient return means which urge the wheels radially outwardly. Although this type of centralizer enables some work to be performed in a deviated well, it is not free from drawbacks.

Firstly, its centering or bearing force on the walls of the casing tends to fall off too rapidly when the diameter of the casing increases. Secondly, in order to satisfy maximum diameter requirements when in the retracted position, e.g., less than 50 mm, the wheels must be of small diameter; they therefore rotate very quickly while a tool with the device is going down a well, which considerably reduces their lifetime. Finally, this type of centralizer is subject to severe shocks each time it passes a joint in the tubing, which shocks rapidly puts the device out of service.

SUMMARY OF THE INVENTION

The present invention seeks to solve the technical problems encountered with such prior art wheeled centering devices.

A first aim of the present invention is to supply a centering device which has wheels of larger diameter, while still keeping within the same maximum outside diameter requirements when in the retracted position.

Another aim of the present invention is to provide a device which applies a substantially constant radial thrust on the inside wall of casings over a wide range of casing diameters.

A further aim of the present invention is to provide a device whose outer surface is free from sharp projections under all circumstances, thereby preventing the device from being put out of service by shocks during lowering.

According to an essential characteristic of the present invention, each wheel is mounted to rotate in a plane which is inclined relative to the radial plane through the wheel-carrying structure on which it is mounted, and the central bar has external recesses to partially receive the wheel-carrying structures when they are fully retracted against the central bar.

In a preferred embodiment, each wheel-carrying structure comprises a generally U-shaped fork with the outside ends of the arms articulated to the tines thereof, the arms being also articulated to the slides, while the wheel is mounted at the bottom of the U on the inside thereon in such a manner that the outside periphery of the wheel projects slightly beyond the associated wheel-carrying structure, and substantially in the radial plane therethrough. The bottoms of the U-shapes of the different forks are peripherally offset relative to the radial plane through each wheel-carrying structure and in the same direction when going round the central bar.

Further, the resilient return means comprise firstly a pair of compression springs, each of which acts between a respective one of the slides and a corresponding shoulder on the central bar located on the side of the slide which is opposite to the other slide, whereby the slides are urged towards each other, and secondly, a curved spring blade mounted parallel with each arm between the slide and the associated wheel carrier, with the concave side of the spring blade facing inwards.

Finally, the forks are externally shaped in such a manner that together they define an assembly having a substantially cylindrical periphery when the wheel-carrying structures are fully retracted against the central bar.

Most advantageously, the wheels are inclined relative to the associated radial plane by an angle of about 10 degrees. Other characteristics and advantages of the invention appear from an examination of the following detailed description together with the accompanying drawings.

DETAILED DESCRIPTION OF THE PREFERRED EMBODIMENT

Figure 1:
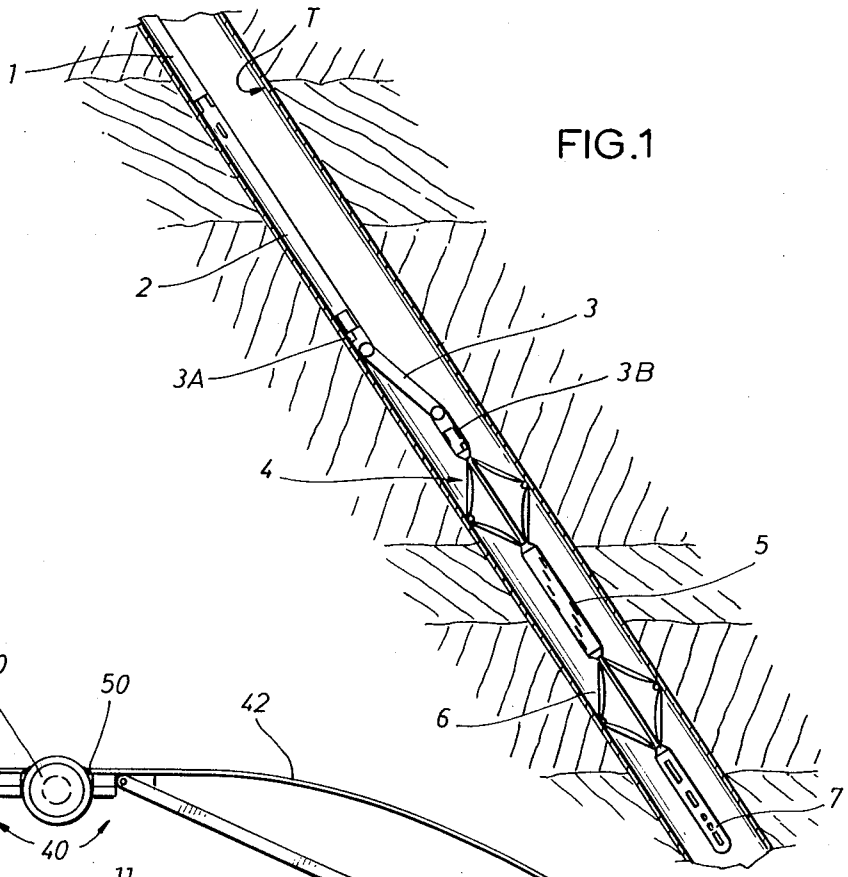
FIG. 1 is a diagram of a tool string for lowering a tool down a well casing, together with prior art centering devices.

In FIG. 1, the symbol T designates overall the casing inserted in a deviated well which passes through successive different underground formations. A tool lowering string is located inside the casing and consists of successive components 1 and 2 which are pivotally connected to each other. A component 3 has universaljoints 3A and 3B at each end enabling it to swing angularly. The joint 3B is connected to a first centering device 4 which is followed by a tool 5 and then by a second centering device 6, and finally by a second tool 7.

The tool 5 is, for example, a device for measuring the transverse dimensions of a borehole as described in the above-mentioned French Pat. No. 81 24021. The tool 7 comprises a reference sensor for measuring the propagation speed of sound waves in the medium filling the casing.

The diagrammatic representation of the centering devices 4 and 6 given in FIG. 1 corresponds to the centralizer described in the above-mentioned article reference SPE 6818.

Figure 2:
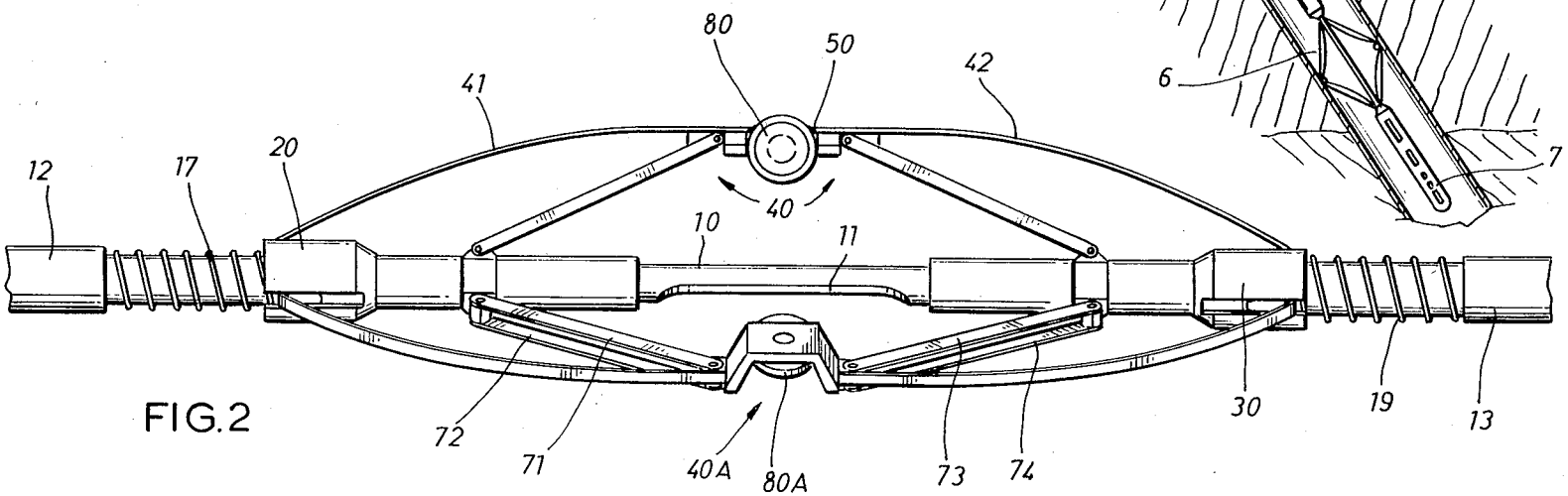
FIG. 2 is a diagrammatic perspective view of a centering device in accordance with the present invention.

Reference is now made to FIG. 2 which is a diagram of a centering device or centralizer in accordance with the present invention.

A central bar 10 is provided at each end with screw threads (not shown) enabling two parts 12 and 13 providing facing shoulders to be fixed thereto. The parts 12 and 13 also serve to connect the central bar in the lowering string, e.g. one of them is connected to the universal joint 3B and the other is connected to the tool (see FIG. 1). It can also be seen from FIG. 1 that two centering devices are generally required.

Two slides 20 and 30 which are described in detail below are slidably mounted on the central bar 10.

The slides serve to retain three radial wheel-carrying structures referenced 40 and 40A (the third structure 40B which is located behind the parts shown is not itself shown in order to clarify the drawing). The three structures are identical and they are disposed at 120 intervals from one another around the central bar 10 and the slides 20 and 30. Only the structure 40A is described below.

The structure 40A comprises a first pair of arms 71 and 72 which are hinged at one end to the slide 20 and a second pair of arms 73 and 74 which are likewise hinged at one end to the slide 30. At their other ends, the arms 71 and 72 are hinged to one tine of a wheel-carrying fork 50. The other two arms 73 and 74 are likewise hinged to the other tine of the fork 50. The two hinge axes provided by the fork are parallel. Hinge pins 67 and 68 can be seen in FIG. 8.

Returning to FIG. 2, a curved spring blade 41 is fixed to one of the tines of the fork 50, and the other end of the spring blade is axially guided to slide along the slide 20. The other tine is likewise fixed to a second spring blade 42.

Each of the forks such as 50 supports a wheel which is mounted to rotate freely thereon.

Finally the resilient return means further include two springs 17 and 19 which act between the end stops 12 and 13 and the slides 20 and 30.

Reference is now made to FIGS. 3 to 7 which show the structure of one of the slides, e.g. the slide 20, in greater detail. The middle of the slide 20 has three projections arranged around its periphery at 120 to one another. Each of these projections services to define the hinge axis for a corresponding one of the pairs of arms such as 71 and 72. Taking the projection 25 as an example, it is sufficiently large in the radial direction to receive a tangential bore 27 which defines the hinge axis of the two bars 71 and 72. An intermediate recess 26 is provided in the radially outer surface of the projection in order to rceive a spring blade such 41 when the centering device is in the fully retracted position. It can also be seen in FIG. 3 that the other hinge axes are referenced 27A and 27B.

Figure 3:
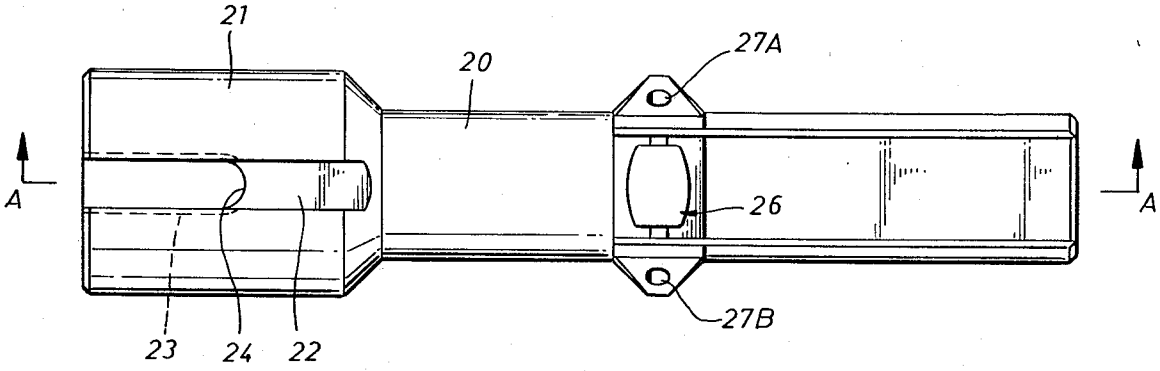
FIGS. 3 and 4 are respectively a radial view and a longitudinal section through one of the slides of the tool of FIG. 2 in accordance with the present invention.
Figure 4:
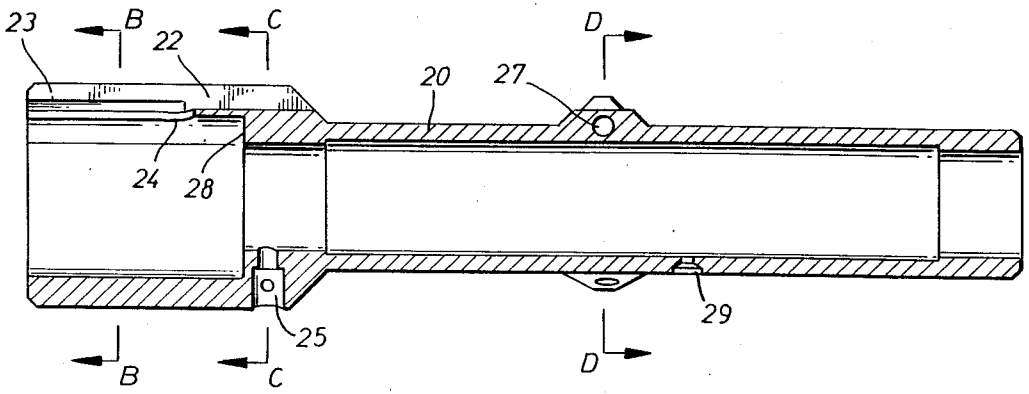
Figure 7:
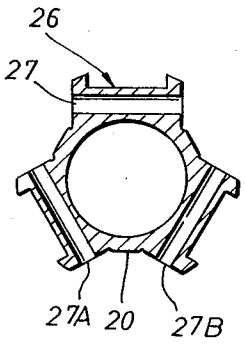
FIGS. 5, 6 and 7 are three cross sections through the slide shown in FIGS. 3 and 4.
Figure 5:
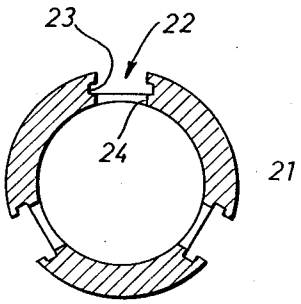
Figure 6:
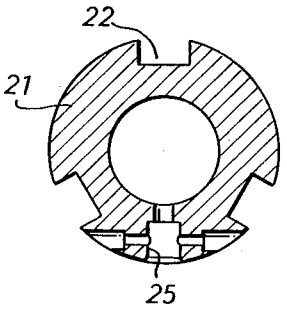

The slide 20 is further provided at its left hand end (as seen in FIGS. 3 and 4) with an end piece 21 having an interior stop 28 for the spring 17. This stop is provided with three longitudinal recesses which lie at 120 to one another in the same planes of symmetry as the projections 25 (see FIGS. 3 to 6). On the outside there is the recess 22 which extends along the length of the end piece, thereby providing a housing for the end of the spring blade 41 when the device is fully retracted. Over a portion of its length starting at the free end the recess 22 is provided with side grooves 23. These grooves serve to slidably house a cross pin 43 (see FIG. 9) mounted at the end of the associated spring blade 42. Over the length of the grooves 23, the recess 22 is in the form of a through slot 24 in order to facilitate machining the grooves 23. Finally, the bottom of the end piece 21 (as seen in FIG. 4) is provided with a hole 25 to receive a pin suitable for preventing the slide from rotating about the central rod, the pin co-operating with a matching groove in the central rod (where it is desired to prevent such rotation). It can further be seen that an orifice 29 is provided to enable the fluid contained in the tubing to pass into the slide, in order to equalize pressures.

It can now be understood that the pairs of arms such as 71 and 72 are hinged to the slide, and also how the curved spring blade 41 is guided to slide on the same slide.

Figure 8:
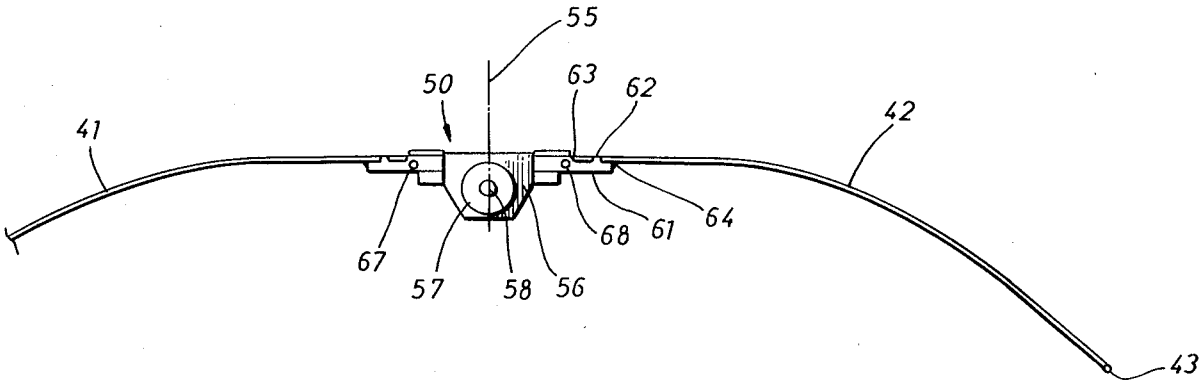
FIGS. 8 and 9 are a circumferential view and a radial view respectively of a portion of a radial wheel-carrying structure of the tool of FIG. 2, including its fork and one of its spring blades.
Figure 9:
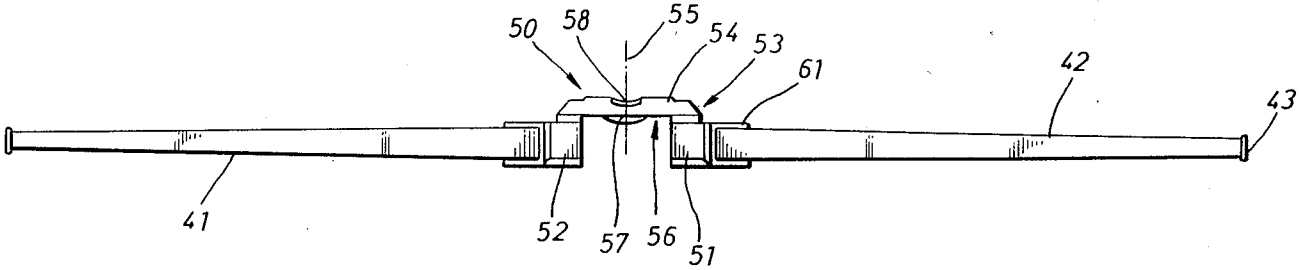
Figure 11:
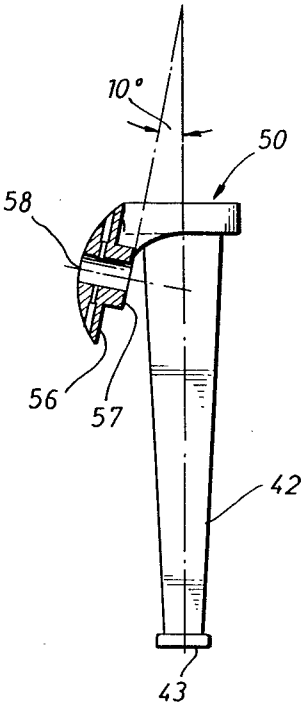
FIG. 11 is an end view corresponding to FIGS. 8 and 9.

FIGS. 8, 9 and 11 show the arrangement of one of the forks such as 50 in greater detail. As mentioned above, the pins 67 and 68 serve as the other pivot points for the pairs of arms 71 and 72, and 73 and 74 respectively. This fixing is to the tines 51 and 52 of the U-shaped fork 50. The tines exend in the radial plane through the associated wheel-carrier in the form of two plates, one of which 61 can be seen clearly in FIG. 8. The plate 61 is provided with a projection 62 which serves as a bearing point for the end of the spring blade 42. The spring blade 42 is also fixed rigidly to the fork 50 by brasing at 64 and at 63. At this point, it may be recalled that the prior art centering device possesses radial structures of triangular geometry. In contrast, the structure in accordance with the invention is only slightly triangular. The person skilled in the art will understand that the points 67 and 68 where the arms are hinged to the fork are far enough apart from each other to provide, in combination with the role performed by the spring blades 41 and 42, a much more flexible suspension for the fork 50 and the wheel 80 carried thereby (the wheel is not shown in FIGS. 8, 9 and 11). FIGS. 8, 9 and 11 also show up another very important characteristic of the invention. The wheel-carrying fork 50 receives the wheel near to the bottom 53 of its U-shape, and more precisely on the inside face 56 thereof as seen from the center of the structure. Further, the sideways offset of the fork 50 is accompanied by its inside face 56 being inclined and consequently the wheel plane is also inclined relative to the radial plane through the associated wheel-carrying structure. The angle of inclination in question is about 10 degrees.

As is shown by FIG. 2, the rolling surface of each wheel such as 80 projects slightly beyond the outside of the associated wheel-carrying structure, and also beyond the inside of the U of each fork 50, i.e. substantially in the radial plane of the associated wheel-carrying structure.

Finally, the bottoms 53 of the Us of the various forks such as 50 are peripherally offset in the same direction relative to the general direction defined by the spring blades 41 and 42 (i.e. the radial plane of the wheel-carrying structure), when going around the central bar 10.

It is then highly advantageous for the outer surfaces 54 of the forks 50 to be shaped so that together they define a substantially cylindrical periphery, when the wheel-carrying structures are fully retracted against the central bar. In other words, the outer contour 54 of the fork is curved in such a manner that it gets closer to the axis of the centering device as it gets further from the radial plane through the associated wheel-carrying structure. It can be said that the fork 50 is thus offset sideways in a position which is slightly closed towards the interior.

Figure 10:
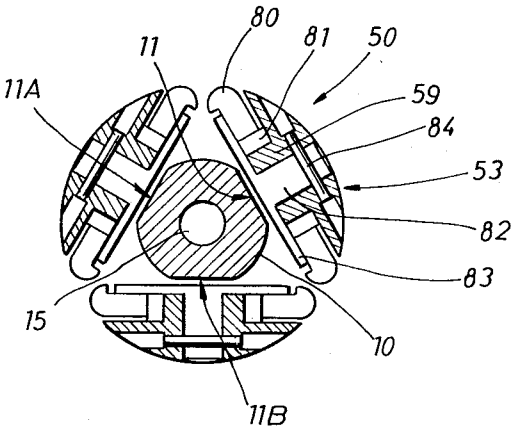
FIG. 10 is a cross section through a centering device in accordance with the invention in the fully retracted position.

Reference is now made to FIG. 10, which is a cross section through a centering device in accordance with the invention in the fully retracted position. This figure also facilitates understanding of the way each wheel is mounted on the associated fork.

Firstly it can be seen that recesses 11, 11A and 11B made in the central bar 10 and shown as flats, serve to receive the wheels in part, thereby helping to minimize the bulk of the device when in the fully retracted position. FIG. 10 also shows the substantially cylindrical peripheral contour of the device when in the retracted position.

The central bar 10 has an inside bore 15 in order to pass conductors to the tool which is situated downstream therefrom.

The mounting of a wheel 80 is now described. The inside face 56 of the fork 50 is provided with an annular central shoulder 59. A bearing 81 is supported thereby. The wheel 80 rotates on the bearing 81. It can be seen that the wheel is hollowed out to enable it to be held by a cheek plate 83 which is integrally mounted to a rod 82 which is received in the bore in the fork 50 where it is retained by a spring clip 84. Such a mounting makes it easy to assemble the wheel while keeping down its bulk, and thus keeping down the bulk of the centering device as a whole when in the retracted position.

The periphery of the wheel 80 is chosen to be of suitable material to give it long life in the harsh conditions found inside well tubing. For the same reasons, it is advantageous for all of the outside portions of the fork 50, and the curved spring blades 41 and 42 to stand up well to the wear they are likely to suffer from episodic contact with the wall of the tubing.

In the presently preferred embodiment of the invention as has just been described, the slides come into contact with, or very nearly into contact with, their respective end stops 12 and 13 when the wheel-carrying structures are in their fully retracted position. In other positions, the two slides are free to move together along the shaft constituted by the central bar 10 in opposition to the springs 17 and 19.

When fully open the angle between the inside arms such as 71 and 72 and the axis of the bar is about 30.

The fully open size of the device is defined both by the components in each radial wheel-carrying structure, i.e. the bars, the geometry of the curved spring baldes 41 and 42, and by the characteristics of the springs 17 and 19 (taking their stops into account).

Further, it has been observed that the disposition of the springs 17 and 19 in accordance with the present invention makes it possible to obtain increasing radial force at the wheels with increasing tubing diameter. For their part, the curved spring blades such as 41 and 42 provide a radial force which, in contrast, reduces with diameter. By combining the two effects, it is possible to obtain a substantially constant radial or centering force which is indepenent of diameter over a fairly wide range of diameters (naturally the diameter must be smaller than the diameter which is reached when the two resilient systems constituted by the compression springs and the spring blades are in their equilibrium position). This characteristic is very important in highly deviated wells, where two of the wheel-carrying structures have to transmit the radial component relative to the tubing of the weight of the centering device and the tool with which it is co-operating.

The Applicant is presently of the opinion that it is preferable to lock the slides against rotation about the central bar, as indicated above. A variant of the invention consists in leaving the slides 20 and 30 free to rotate about the central bar. It has been observed that it is sufficient to slightly round the edges of the flats 11, 11A and 11B provided on the central bar to ensure that the wheels can of their own accord take up a fully retracted position even if the two slides are badly placed relative to the flats at the moment of approach. Generally speaking it is possible to machine the central bar to facilitate wheel insertion in to the recesses thereon as he wheel-carrying structures come close to their fully retracted position.

The above description relates to a single centering device. As shown in FIG. 2, most applications require two centering devices placed on either side of a tool 5, and another tool 7 may be cantelevered out from the leading end of a string being lowered. Naturally this arrangement lies within the scope of the invention.

I claim:

1. a device for centering a tool forming a part of a tool string, inside a cased well comprising:

a central bar suitable for being integrated in a tool string for lowering the tool inside the tubing;

two slides which are slidable over a limited range of said central bar;

a series of wheel-carrying structures of generally triangular geometry defined by arms which are hinged to said slides;

a series of wheels, each wheel being mounted to one of said wheel-carrying structures in a plane which is inclined relative to the radial plane defined by said one of said wheel-carrying structures to rotate freely on said one of said wheel-carrying structures in said inclined plane in such a manner that the periphery of said wheel projects radially outwardly; and resilient return means urging the wheel-carrying structures radially outwardly.

2. A device according to claim 1, wherein each of said wheel-carrying structures comprises a generally U-shaped fork having two tines on which are hinged the outer ends of the arms which are also hinged to the two slides, while the wheel is mounted on the bottom of the U on the inside thereof in a manner such that the outer periphery of the wheel projects slightly beyond the associated wheel-carrying structure, substantially in the radial plane therethrough, and the bottoms of the Us of the various forks are peripherally offset relative to the radial plane through each wheel-carrying structure and in the same direction when going round the central bar.

3. A device according to claim 2 wherein said forks are shaped on the outside so that together they define a substantially cylindrical periphery when the wheel-carrying structures are fully retracted against the central bar.

4. A device according to claim 2, wherein said slides are prevented from rotating about the central bar.

5. A device according to claim 1, wherein said resilient return means comprise both a pair of compression springs which act between the slides and shoulders which are situated on the central bar on the side of each of the slides which is opposite to the other slide in such a manner as to urge the slides towards each other, and a curved spring blade in parallel with the arms between each slide and the relevant wheel-carrying fork with its concave side facing inwardly.

6. A device according to claim 1, wherein the planes in which said wheels are mounted are inclined at an angle of about 10 degrees from the radial planes defined by the respective wheel-carrying structures.

7. A device according to claim 1, wherein said slides are free to rotate about the central bar.

8. A device according to claim 1, wherein the outer surface of said central bar comprises recesses to receive said wheels when said wheel-carrying structures are in a retracted position.

9. A device according to claim 8, wherein said central bar includes a through bore to pass conductors towards a tool situated downstream therefrom.

10. A device for centering a tool forming a part of a tool string, inside a cased well comprising:

a central bar suitable for being integrated in a tool string for lowering the tool inside the tubing;

two slides which are slidable over a limited range of said central bar;

a series of wheel-carrying structures of generally triangular geometry defined by arms which are hinged to said slides;

a series of wheels, each wheel being mounted to one of said wheel carrying structures in a plane which is inclined relative to the radial plane defined by said one of said wheel-carrying structures to rotate freely on said one of said wheel-carrying structures in said inclined plane in such a manner that the periphery of said wheel projects radially outwardly and that the wheels when said wheel-carrying structures are fully retracted against the central bar are received in recesses provided in the outer surface of said central bar; and resilient return means urging the wheel-carrying structures radially outwardly.

11. A device according to claim 10, wherein said resilient return means comprise both a pair of compression springs which act between the slides and shoulders which are situated on the central bar on the side of each of the slides which is opposite to the other slide in such a manner as to urge the slides towards each other, and a curved spring blade in parallel with the arms between each slide and the relevant wheel-carrying fork, with its concave side facing inwardly.

12. A device according to claim 10, wherein the planes in which said wheels are mounted are inclined at an angle of about 10 degrees from radial planes defined by the respective wheel-carrying structures.

13. A device according to claim 12, wherein said slides are prevented from rotating about the central bar.

14. A device according to claim 10, wherein said recesses are shaped such as to facilitate insertion of the wheels into said recesses when said structures approach their fully retracted position.

* * * * *